US012747739B1

(12) United States Patent
Sobanski et al.

(10) Patent No.: US 12,747,739 B1
(45) Date of Patent: Sep. 29, 2026

(54) VARIABLE VANE SYSTEM FOR AIRCRAFT POWERPLANT

(71) Applicant: RTX Corporation, Farmington, CT (US)

(72) Inventors: Jon E. Sobanski, Glastonbury, CT (US); Jeffrey T. Morton, Glastonbury, CT (US); Andrew E. Breault, Bolton, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 19/247,702

(22) Filed: Jun. 24, 2025

(51) Int. Cl.
*F04D 29/56* (2006.01)
*F04D 27/00* (2006.01)

(52) U.S. Cl.
CPC ..... *F04D 29/563* (2013.01); *F04D 27/002* (2013.01); *F04D 27/009* (2013.01)

(58) Field of Classification Search
CPC ..... F01D 17/162; F01D 17/16; F01D 17/105; F01D 17/20; F01D 9/04; F01D 7/00; F01D 9/00; F01D 9/041; F04D 27/002; F04D 27/009; F04D 29/563; F04D 27/0246; F04D 29/522; F05D 2260/76; F05D 2220/323; F05D 2260/56; F05D 2270/58; F05D 2250/90; F05D 2260/50; F05D 2270/66; F05D 2230/50; F05D 2230/51; F05D 2270/62; F05B 2260/50; F16C 3/22
See application file for complete search history.

(56) References Cited

U.S. PATENT DOCUMENTS 3,861,822 A * 1/1975 Wanger ..... F04D 29/563 415/162
4,295,784 A * 10/1981 Manning ..... F01D 17/20 415/162
7,273,346 B2 * 9/2007 Bouru ..... F01D 17/162 415/162
7,322,790 B2 * 1/2008 Bouru ..... F04D 29/563 415/162
8,734,091 B2 5/2014 Moniz
(Continued)

FOREIGN PATENT DOCUMENTS

DE 102022112652 A1 * 11/2023 ..... F04D 29/563
FR 2601074 B1 5/1990

OTHER PUBLICATIONS

Machine Translation of DE 102022112652 A1 [retrieved on Dec. 9, 2025]. Retrieved from: Espacenet. (Year: 2025).*

*Primary Examiner* — Eric J Zamora Alvarez
(74) *Attorney, Agent, or Firm* — Getz Balich LLC

(57) ABSTRACT

An assembly includes first vanes, second vanes, a rotor and an actuation system. The actuation system includes a first ring and a second ring. The first ring is coupled to each first vane. The second ring is coupled to each second vane. During a first mode, the actuation system is configured to rotate the first ring in a first rotational direction about the axis, rotate the second ring in a second rotational direction about the axis, and pivot each of the first vanes and each of the second vanes in a common first pivot direction. During a second mode, the actuation system is configured to rotate the first ring in the second rotational direction about the axis, rotate the second ring in the first rotational direction about the axis, and pivot each of the first vanes and each of the second vanes in a common second pivot direction.

19 Claims, 10 Drawing Sheets

(56) References Cited

U.S. PATENT DOCUMENTS

| | | | | |
|---|---|---|---|---|
| 10,107,194 | B2 | 10/2018 | Lahmer | |
| 10,626,879 | B2 | 4/2020 | Schwarz | |
| 2010/0232935 | A1 | 9/2010 | Twell | |
| 2023/0077444 | A1 * | 3/2023 | Ostermeir | F02C 9/20 415/127 |

* cited by examiner

VARIABLE VANE SYSTEM FOR AIRCRAFT POWERPLANT

BACKGROUND OF THE DISCLOSURE

1. Technical Field

This disclosure relates generally to an aircraft and, more particularly, to an air circuit and/or a variable vane system for a powerplant of the aircraft.

2. Background Information

An aircraft powerplant such as a turbofan propulsion system may include an air circuit for supplying pressurized air to an air system. The aircraft powerplant may also include a variable vane system along a core flowpath. Various types and configurations of air circuits and variable vane systems are known in the art. While these known air circuits and variable vane systems have various benefits, there is still room in the art for improvement.

SUMMARY OF THE DISCLOSURE

According to an aspect of the present disclosure, an assembly is provided for an aircraft powerplant. This assembly includes a plurality of first vanes, a plurality of second vanes, a rotor and an actuation system. The first vanes are arranged circumferentially about an axis in a first vane array. Each of the first vanes is pivotable about a respective first vane pivot axis. The second vanes are arranged circumferentially about the axis in a second vane array. Each of the second vanes is pivotable about a respective second vane pivot axis. The rotor is rotatable about the axis and includes a plurality of first blades. The first blades are arranged circumferentially about the axis in a first blade array. The first blade array is arranged axially next to and between the first vane array and the second vane array along a flowpath. The actuation system includes a first ring and a second ring. The first ring is operatively coupled to each of the first vanes. The second ring is operatively coupled to each of the second vanes. During a first mode, the actuation system is configured to rotate the first ring in a first rotational direction about the axis, rotate the second ring in a second rotational direction about the axis, and pivot each of the first vanes and each of the second vanes in a common first pivot direction. During a second mode, the actuation system is configured to rotate the first ring in the second rotational direction about the axis, rotate the second ring in the first rotational direction about the axis, and pivot each of the first vanes and each of the second vanes in a common second pivot direction.

According to another aspect of the present disclosure, another assembly is provided for an aircraft powerplant. This assembly includes a plurality of first vanes, a plurality of second vanes, a rotor, a wall structure and an actuation system. The first vanes are arranged circumferentially about an axis in a first vane array. Each of the first vanes is pivotable about a respective first vane pivot axis. The second vanes are arranged circumferentially about the axis in a second vane array. Each of the second vanes is pivotable about a respective second vane pivot axis. A rotor is rotatable about the axis and includes a plurality of first blades. The first blades are arranged circumferentially about the axis in a first blade array. The wall structure extends axially along and circumferentially about the first vane array, the second vane array and the first blade array. The wall structure forms an outer peripheral boundary of a flowpath that extends axially across the first vane array, the second vane array and the first blade array with the first blade array arranged axially next to and between the first vane array and the second vane array along the flowpath. The actuation system includes a first ring, a second ring, a linkage system and an actuator. The first ring is operatively coupled to each of the first vanes. The second ring is operatively coupled to each of the second vanes. The linkage system operatively couples the actuator to the first ring and the second ring. The actuation system is configured to pivot the first vanes and the second vanes by using the actuator to rotate the first ring and the second ring in opposite directions about the axis.

According to still another aspect of the present disclosure, another assembly is provided for an aircraft powerplant. This assembly includes a plurality of first vanes, a plurality of second vanes, a rotor, a wall structure and an actuation system. The first vanes are arranged circumferentially about an axis in a first vane array. Each of the first vanes is pivotable about a respective first vane pivot axis. The second vanes are arranged circumferentially about the axis in a second vane array. Each of the second vanes is pivotable about a respective second vane pivot axis. The rotor is rotatable about the axis and includes a plurality of first blades. The first blades are arranged circumferentially about the axis in a first blade array. The wall structure extends axially along and circumferentially about the first vane array, the second vane array and the first blade array. The wall structure forms an outer peripheral boundary of a flowpath that extends axially across the first vane array, the second vane array and the first blade array with the first blade array arranged axially next to and between the first vane array and the second vane array along the flowpath. The actuation system includes a first ring, a second ring, a linkage system and an actuator. The first ring is operatively coupled to each of the first vanes. The second ring is operatively coupled to each of the second vanes. The linkage system operatively couples the actuator to the first ring and the second ring. The actuation system is configured to rotate the first ring and the second ring about the axis using the actuator to pivot the first vanes and the second vanes. The first vane pivot axis of each of the first vanes and the second vane pivot axis of each of the second vanes are arranged axially between the first ring and the second ring along the axis.

The actuation system may also include an actuator. The first ring may operatively couple the actuator to each of the first vanes. The second ring may operatively couple the actuator to each of the second vanes. The actuation system may be configured to rotate the first ring and the second ring using the actuator.

The actuation system may also include an actuator and a linkage system operatively coupling the actuator to the first ring and the second ring.

The assembly may also include a fixed structure. The actuation system may also include a first crank, a second crank and a first linkage. The first crank may be pivotally coupled to the fixed structure and the first ring. The second crank may be pivotally coupled to the fixed structure and the second ring. The first linkage may operatively couple and may be pivotally coupled to the first crank and the second crank.

The first crank may include a first ring arm and a first linkage arm. The first ring may be pivotally coupled to the first ring arm. The first linkage may be pivotally coupled to the first linkage arm. The fixed structure may be pivotally coupled to the first crank at an intersection between the first ring arm and the first linkage arm. In addition or alternatively, the second crank may include a second ring arm and a second linkage arm. The second ring may be pivotally coupled to the second ring arm. The first linkage may be pivotally coupled to the second linkage arm. The fixed structure may be pivotally coupled to the second crank at an intersection between the second ring arm and the second linkage arm.

The first ring arm may project away from the first linkage arm in a first axial direction along the axis. The second ring arm may project away from the second linkage arm in a second axial direction along the axis.

The first linkage arm may project away from the first ring arm in a first circumferential direction about the axis. The second linkage arm may project away from the second ring arm in the first circumferential direction about the axis.

The assembly may also include a plurality of third vanes arranged circumferentially about the axis in a third vane array. Each of the third vanes may be pivotable about a respective third vane pivot axis. The rotor may also include a plurality of second blades. The second blades may be arranged circumferentially about the axis in a second blade array. The second blade array may be arranged axially next to and between the second vane array and the third vane array along the flowpath. The actuation system may also include a third ring, a third crank and a second linkage. The third ring may be operatively coupled to each of the third vanes. The third crank may be pivotally coupled to the fixed structure and the third ring. The second linkage may operatively couple and may be pivotally coupled to the second crank and the third crank.

The first crank may include a first ring arm and a first linkage arm. The first ring may be pivotally coupled to the first ring arm. The first linkage may be pivotally coupled to the first linkage arm. The fixed structure may be pivotally coupled to the first crank at an intersection between the first ring arm and the first linkage arm. The second crank may include a second ring arm and a plurality of second linkage arms. The second ring may be pivotally coupled to the second ring arm. The first linkage may be pivotally coupled to a first of the second linkage arms. The second linkage may be pivotally coupled to a second of the second linkage arms. The fixed structure may be pivotally coupled to the second crank at an intersection between the second ring arm and the second linkage arms. The third crank may include a third ring arm and a third linkage arm. The third ring may be pivotally coupled to the third ring arm. The second linkage may be pivotally coupled to the third linkage arm. The fixed structure may be pivotally coupled to the third crank at an intersection between the third ring arm and the third linkage arm.

The assembly may also include an actuation shaft, a first linkage and a second linkage. The actuation shaft may include a shaft, a first cam element and a second cam element axially spaced from the first cam element along the shaft. The first cam element may be rotatable with the shaft. The second cam element may be rotatable with the shaft. The first linkage may operatively couple and may be pivotally coupled to first cam element and the first ring. The second linkage may operatively couple and may be pivotally coupled to second cam element and the second ring.

A coupling between the first linkage and the first cam element may be disposed radially between the first ring and the shaft. The shaft may be disposed radially between the second ring and a coupling between the second linkage and the second cam element.

The first linkage and the second linkage may be disposed to a common circumferential side of the actuation shaft about the axis.

A rotational axis of the actuation shaft may be parallel to the axis.

The actuation system may also include a plurality of first actuation arms and a plurality of second actuation arms. Each of the first actuation arms may be movable with a respective one of the first vanes. Each of the first actuation arms may be pivotably coupled to the first ring. Each of the second actuation arms may be movable with a respective one of the second vanes. Each of the second actuation arms may be pivotably coupled to the second ring.

Each of the first actuation arms may be disposed radially outboard of and may axially overlap the first ring. In addition or alternatively, each of the second actuation arms may be disposed radially outboard of and may axially overlap the second ring.

The first vane pivot axis of each of the first vanes and the second vane pivot axis of each of the second vanes may be arranged axially between the first ring and the second ring along the axis.

The assembly may also include an air circuit comprising a bleed aperture. The bleed aperture may be disposed at an outer peripheral boundary of the flowpath axially between the first vane array and the first blade array. The air circuit may be configured to bleed air from the flowpath through the bleed aperture.

The bleed aperture may be downstream of the first vane array along the flowpath.

The bleed aperture may be downstream of the first blade array along the flowpath.

A wall structure may extend axially along and circumferentially about the first vane array, the second vane array and the first blade array. The wall structure may form an outer peripheral boundary of the flowpath. The wall structure may be disposed radially between (a) the flowpath and (b) the first ring and the second ring.

The assembly may also include a compressor section, a combustor section and a turbine section. The compressor section may include the first vanes, the second vanes and the rotor. The flowpath may extend through the compressor section, the combustor section and the turbine section from an airflow inlet into the flowpath to a combustion products exhaust from the flowpath.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
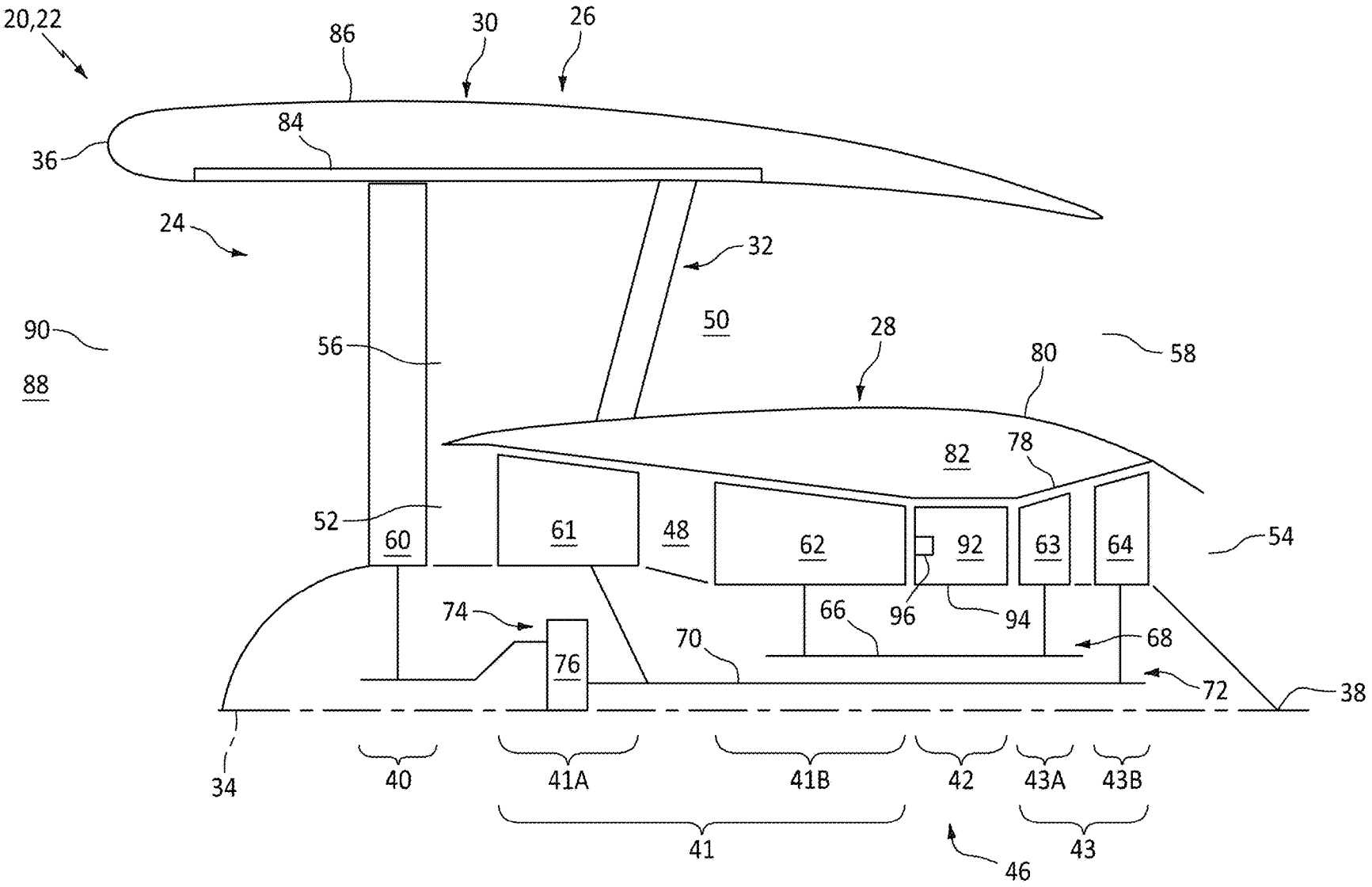
FIG. 1 is a partial schematic illustration of an aircraft propulsion system.

FIG. 1 illustrates a powerplant 20 for an aircraft. The aircraft may be an airplane, a drone (e.g., an unmanned aerial vehicle (UAV)) or any other manned or unmanned aerial vehicle or system. For ease of description, the aircraft powerplant 20 is described below as a propulsion system 22 for the aircraft and, more particularly, as a turbofan propulsion system. The aircraft powerplant 20 of the present disclosure, however, is not limited to such an exemplary propulsion system. The aircraft propulsion system 22, for example, may alternatively be configured as a turbojet propulsion system, a turboprop propulsion system, a turboshaft propulsion system, a propfan propulsion system, a pusher fan propulsion system, or any other type of ducted and/or open propulsor rotor propulsion system. Moreover, the aircraft powerplant 20 is not limited to propulsion system applications. The aircraft powerplant 20, for example, may also (or alternatively) be configured as an electrical power system for the aircraft; e.g., an auxiliary power unit (APU).

The aircraft propulsion system 22 includes a gas turbine engine 24 (e.g., a turbofan engine) housed within a stationary propulsion system housing 26. The propulsion system housing 26 of FIG. 1 includes an inner housing structure 28, an outer housing structure 30 and a guide vane structure 32 (e.g., a fan exit guide vane (FEGV) structure), where the guide vane structure 32 extends radially between and is connected to the inner housing structure 28 and the outer housing structure 30. The aircraft propulsion system 22 extends axially along an axis 34 of the aircraft propulsion system 22 between an axial upstream, forward end 36 of the aircraft propulsion system 22 and an axial downstream, aft end 38 of the aircraft propulsion system 22. The propulsion system axis 34 may be a centerline axis of the aircraft propulsion system 22, the turbine engine 24 and/or one or more of its members. The propulsion system axis 34 may also or alternatively be a rotational axis for one or more members of the turbine engine 24.

The aircraft propulsion system 22 and its turbine engine 24 of FIG. 1 include a propulsor section 40 (e.g., a fan section), a compressor section 41, a combustor section 42 and a turbine section 43. The compressor section 41 of FIG. 1 includes a low pressure compressor (LPC) section 41A and a high pressure compressor (HPC) section 41B. The turbine section 43 of FIG. 1 includes a high pressure turbine (HPT) section 43A and a low pressure turbine (LPT) section 43B. At least (or only) the LPC section 41A, the HPC section 41B, the combustor section 42, the HPT section 43A and the LPT section 43B collectively form a core 46 (e.g., a gas generator) of the turbine engine 24. The aircraft propulsion system 22 and its turbine engine 24 of FIG. 1 also include a core flowpath 48 (e.g., an annular core flowpath) and a bypass flowpath 50 (e.g., an annular bypass flowpath). The core flowpath 48 extends sequentially through the LPC section 41A, the HPC section 41B, the combustor section 42, the HPT section 43A and the LPT section 43B from an airflow inlet 52 into the core flowpath 48 to a combustion products exhaust 54 out from the core flowpath 48. The bypass flowpath 50 extends through a bypass duct from an airflow inlet 56 into the bypass flowpath 50 to an airflow exhaust 58 from the bypass flowpath 50, where the bypass duct may be formed by the inner housing structure 28 and the outer housing structure 30. The bypass flowpath 50 and its bypass duct are configured to bypass (e.g., are disposed radially outboard of and extend along) the engine core 46 and the inner housing structure 28.

The propulsor section 40, the LPC section 41A, the HPC section 41B, the combustor section 42, the HPT section 43A and the LPT section 43B may be arranged sequentially along the propulsion system axis 34 within the propulsion system housing 26. The propulsor section 40 includes a bladed propulsor rotor 60; e.g., a fan rotor. The LPC section 41A includes a bladed low pressure compressor (LPC) rotor 61. The HPC section 41B includes a bladed high pressure compressor (HPC) rotor 62. The HPT section 43A includes a bladed high pressure turbine (HPT) rotor 63. The LPT section 43B includes a bladed low pressure turbine (LPT) rotor 64.

The HPC rotor 62 is coupled to and rotatable with the HPT rotor 63. The HPC rotor 62 of FIG. 1, for example, is connected to the HPT rotor 63 through a high speed shaft 66. At least (or only) the HPC rotor 62, the HPT rotor 63 and the high speed shaft 66 collectively form a high speed rotating structure 68; e.g., a high speed spool of the turbine engine 24 and its engine core 46. This high speed rotating structure 68 of FIG. 1 and its members 62, 63 and 66 are rotatable about the propulsion system axis 34. However, it is contemplated the high speed rotating structure 68 may alternatively be rotatable about another axis radially and/or angularly offset from the rotational axis of the propulsor rotor 60 and/or the centerline axis of the turbine engine 24.

The LPC rotor 61 is coupled to and rotatable with the LPT rotor 64. The LPC rotor 61 of FIG. 1, for example, is connected to the LPT rotor 64 through a low speed shaft 70. At least (or only) the LPC rotor 61, the LPT rotor 64 and the low speed shaft 70 collectively form a low speed rotating structure 72; e.g., a low speed spool of the turbine engine 24 and its engine core 46. This low speed rotating structure 72 of FIG. 1 and its members 61, 64 and 70 are rotatable about the propulsion system axis 34. However, it is contemplated the low speed rotating structure 72 may alternatively be rotatable about another axis radially and/or angularly offset from the rotational axis of the propulsor rotor 60 and/or the centerline axis of the turbine engine 24.

The low speed rotating structure 72 is coupled to the propulsor rotor 60 through a rotating structure-to-propulsor (RSP) drivetrain 74. The RSP drivetrain 74 may be configured as a geared drivetrain, where a geartrain 76 (e.g., a transmission, a speed change device, an epicyclic gear system, etc.) is disposed between and operatively couples the propulsor rotor 60 to the low speed rotating structure 72 and its LPT rotor 64. With this arrangement, the propulsor rotor 60 may rotate at a different (e.g., slower) rotational speed than the low speed rotating structure 72 and its LPT rotor 64. Here, the propulsor rotor 60 and the low speed rotating structure 72 may rotate in a common (the same) direction about the propulsion system axis 34 or in opposite directions about the propulsion system axis 34 depending, for example, upon the specific configuration of the geartrain 76. Alternatively, the RSP drivetrain 74 may be configured as a direct-drive drivetrain, where the geartrain 76 is omitted. With such an arrangement, the propulsor rotor 60 rotates at a common (the same) rotational speed as the low speed rotating structure 72 and its LPT rotor 64.

The inner housing structure 28 of FIG. 1 includes an inner case 78 (e.g., a core case) for the turbine engine 24, an inner nacelle structure 80 (sometimes referred to as an inner fixed structure (IFS)) and an internal inner housing compartment 82 (e.g., an engine core compartment). The inner case 78 is disposed radially outboard of, extends axially along and may circumscribe one or more or all of the engine sections 41A-43B and the engine rotors 61-64. The inner case 78 may thereby house and provide a support structure for the respective engine sections 41A-43B and the engine rotors 61-64. The inner nacelle structure 80 is configured to provide an aerodynamic cover over the engine core 46 and its inner case 78. The inner housing compartment 82 of FIG. 1 is formed by and is disposed radially between the inner case 78 and an inner barrel of the inner nacelle structure 80. The inner housing structure 28 and its inner nacelle structure 80 may also form a radial inner peripheral boundary of the bypass flowpath 50.

The outer housing structure 30 of FIG. 1 includes an outer case 84 (e.g., a fan case) for the turbine engine 24 and an outer nacelle structure 86. The outer case 84 is disposed radially outboard of, extends axially along and may circumscribe the propulsor section 40 and its propulsor rotor 60. The outer case 84 may thereby house and may be configured as a containment structure for the propulsor section 40 and its propulsor rotor 60. The outer nacelle structure 86 is configured to provide an aerodynamic cover over the outer case 84. The outer housing structure 30 and its outer nacelle structure 86 may also form a radial outer peripheral boundary of the bypass flowpath 50. Of course, where the aircraft propulsion system 22 is alternatively configured as an open propulsor rotor propulsion system (e.g., the propulsor rotor 60 is an open propulsor rotor), the outer housing structure 30 may be omitted to expose the propulsor rotor 60 to an environment 88 external to the aircraft and its aircraft propulsion system 22.

During operation of the aircraft propulsion system 22 of FIG. 1, ambient air from the external environment 88 enters the aircraft propulsion system 22 and its turbine engine 24 through an airflow inlet 90 into the aircraft propulsion system 22. This air is propelled by the rotating propulsor rotor 60 in a downstream, aft direction towards the propulsion system aft end 38.

An outer stream of the air propelled by the rotating propulsor rotor 60 is directed into the bypass flowpath 50 through its bypass inlet 56. This air entering the bypass flowpath 50 may be referred to as "bypass air". The guide vane structure 32 conditions (e.g., straightens out, de-swirls, etc.) the flow of the bypass air within the bypass duct. This conditioned bypass air is subsequently directed out of the aircraft propulsion system 22 through the bypass exhaust 58 to provide forward thrust. This propulsion of the bypass air may account for a majority of the forward thrust generated by the aircraft propulsion system 22 and its turbine engine 24 of FIG. 1.

An inner stream of the air propelled by the rotating propulsor rotor 60 is directed into the core flowpath 48 through its core inlet 52. This air entering the core flowpath 48 may be referred to as "core air". This core air is compressed by the LPC rotor 61 and the HPC rotor 62 and is directed into a combustion chamber 92 (e.g., annular combustion chamber) of a combustor 94 (e.g., annular combustor) in the combustor section 42. Fuel is injected into the combustion chamber 92 by one or more fuel injectors 96 and mixed with the compressed core air to provide a fuel-air mixture. This fuel-air mixture is ignited and combustion products thereof flow through and sequentially drive rotation of the HPT rotor 63 and the LPT rotor 64. The rotation of the HPT rotor 63 and the LPT rotor 64 respectively drive rotation of the HPC rotor 62 and the LPC rotor 61 and, thus, compression of the air received from the core inlet 52. The rotation of the LPT rotor 64 also drives rotation of the propulsor rotor 60 through the RSP drivetrain 74.

While the turbine engine 24 is described above with a particular two rotating structure arrangement (e.g., a two-spool architecture), the present disclosure is not limited thereto. For example, the turbine engine 24 may also include another rotating structure with a bladed compressor rotor in the compressor section 41 and a bladed turbine rotor in the turbine section 43; e.g., an intermediate speed spool for the engine core 46.

Figure 2:
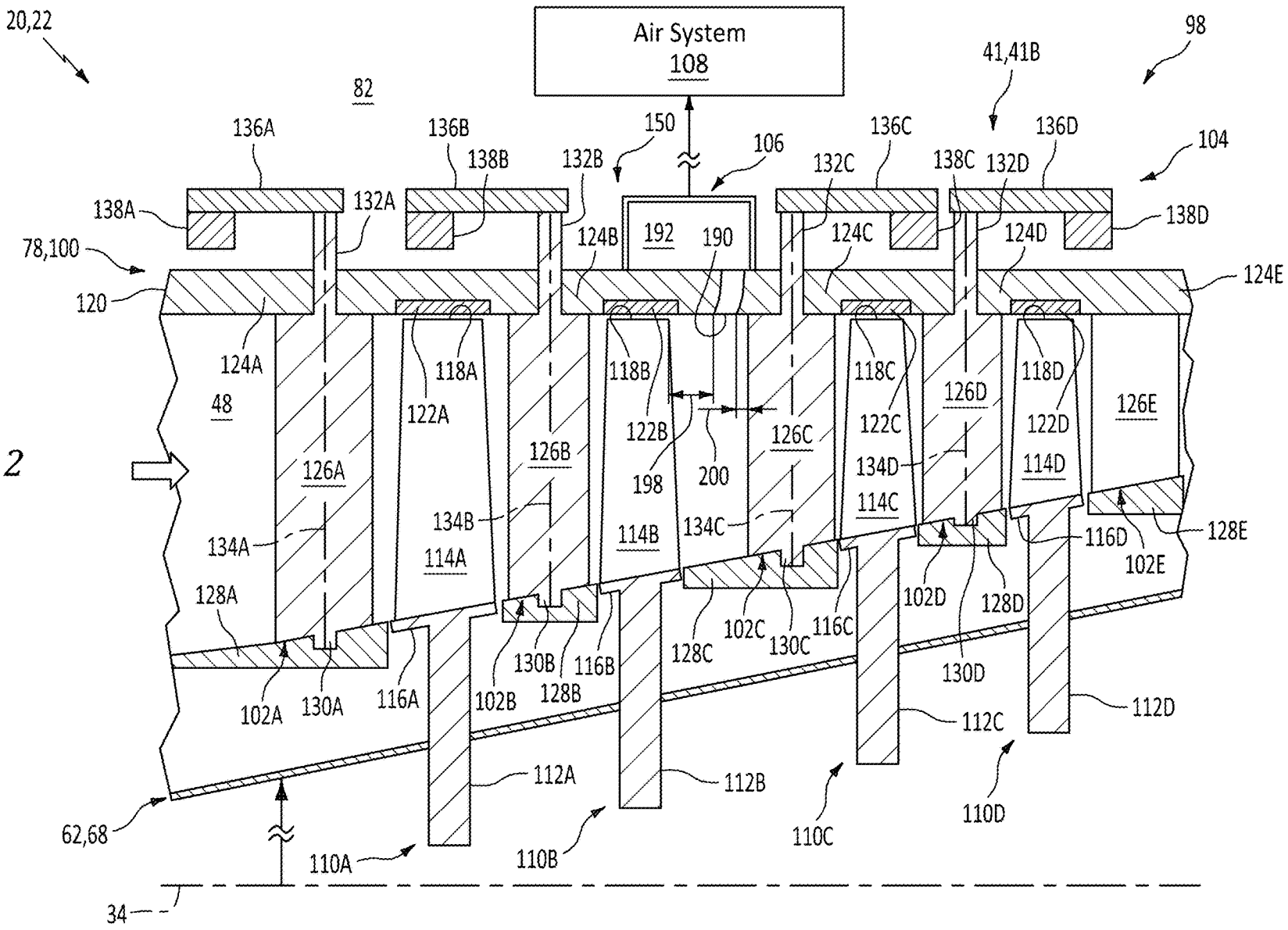
FIG. 2 is a partial sectional illustration of an assembly for the aircraft propulsion system along a compressor section.

FIG. 2 partially illustrates an assembly 98 for the aircraft propulsion system 22 along the HPC section 41B of the turbine engine 24. This propulsion system assembly 98 includes the HPC rotor 62, a high pressure compressor (HPC) wall structure 100, a plurality of high pressure compressor (HPC) vane arrangements 102A-E (generally referred to as "102"), and a vane actuation system 104 for actuating the HPC vane arrangements 102A-D where a select set of the HPC vane arrangements are shown in FIG. 2 for ease of illustration. The propulsion system assembly 98 of FIG. 2 also includes an air circuit 106 configured to service an air system 108 for the aircraft. For ease of description, this air system 108 may be generally described below as an environmental control system (ECS) for one or more internal conditioned volumes within the aircraft; e.g., an aircraft cockpit, an aircraft cabin, etc. The present disclosure, however, is not limited to such an exemplary aircraft air system. The air system 108, for example, may alternatively be configured as part of a ventilation system for the aircraft propulsion system 22, a thermal management system (TMS) for the aircraft propulsion system 22, a buffer air system for the aircraft propulsion system 22, and/or the like.

The HPC rotor 62 of FIG. 2 is configured with a plurality of high pressure compressor (HPC) rotor stages 110A-D (generally referred to as "110"), a select set of which are shown in FIG. 2 for ease of illustration. These rotor stages 110A-D are sequentially arranged longitudinally along the core flowpath 48. The rotor stage 110A may be configured as an upstream-most rotor stage of the HPC rotor 62 longitudinally along the core flowpath 48. The rotor stage 110A may thereby be a rotor stage of the HPC rotor 62 (a) located fluidly closest to the LPC section 41A and its LPC rotor 61 (see FIG. 1) longitudinally along the core flowpath 48 and (b) located farthest from the combustor section 42 (see FIG. 1) longitudinally along the core flowpath 48.

Each of the rotor stages 110A-D of FIG. 2 includes a rotor base 112A-D (generally referred to as "112") (e.g., a disk) and a plurality of compressor blades 114A-D (generally referred to as "114"). The compressor blades 114 are arranged and may be equispaced circumferentially around the rotor base 112 and the propulsion system axis 34 in an array; e.g., an annular compressor blade array. Each of the compressor blades 114 is connected to the rotor base 112 at or near a radial outer periphery of the rotor base 112. Each compressor blade 114, for example, may include an attachment (e.g., a root such as a dovetail root or a firtree root) inserted into and mated with a respective receptacle (e.g., slot such as a dovetail slot or a firtree slot) in the rotor base 112 to mechanically attach the respective compressor blade 114 to the rotor base 112. In another example, each compressor blade 114 may be welded or otherwise bonded to the rotor base 112. In still another example, each compressor blade 114 may be formed as an integral part of the rotor base 112. Each compressor blade 114 may be configured as or otherwise includes a compressor blade airfoil.

Each compressor blade 114 and its blade airfoil are disposed radially outboard of and are connected to a platform 116A-D (generally referred to as "116") of the respective rotor stage 110A-D at a base of the blade airfoil. The platform 116 of FIG. 2 is configured to form a radial inner peripheral boundary of a section of the core flowpath 48 that extends longitudinally across the respective rotor stage 110. A respective circumferential section of the platform 116 may be configured as part of the respective compressor blade 114 where, for example, that compressor blade 114 is mechanically attached to the rotor base 112. Alternatively, the platform 116 may be configured as part of the rotor base 112 where, for example, the compressor blades 114 are bonded to or formed integral with the rotor base 112. The present disclosure, however, is not limited to the foregoing exemplary platform arrangements. Each compressor blade 114 and its blade airfoil project spanwise along a span line of the respective compressor blade 114 and its blade airfoil (e.g., generally radially respective to the propulsion system axis 34) from the platform 116 to a tip 118A-D (generally referred to as "118") of the respective compressor blade 114 and its blade airfoil. Each compressor blade 114 and its blade airfoil extend chordwise between a leading edge of the respective compressor blade 114 and its blade airfoil and a trailing edge of the respective compressor blade 114 and its blade airfoil.

The HPC wall structure 100 may be configured as, or may otherwise be included as part of, the inner case 78. The HPC wall structure 100 is configured to form a radial outer peripheral boundary of the core flowpath 48 at least longitudinally along the HPC section 41B shown in FIG. 2. The HPC wall structure 100 of FIG. 2, for example, includes an engine casing 120 and a plurality of rotor shrouds 122A-D (generally referred to as "122"). The HPC wall structure 100 and its engine casing 120 extend axially along (e.g., axially overlap) and extend circumferentially about (e.g., circumscribe) the HPC rotor 62 and its rotor stages 110 as well as the HPC vane arrangements 102. The HPC wall structure 100 and its engine casing 120 may thereby house the HPC rotor 62 and the vane arrangements 102. The engine casing 120 may also form a radial outer platform 124A-E (generally referred to as "124") for each respective HPC vane arrangement 102A-E. Each outer platform 124 is disposed radially outboard of, axially overlaps and circumscribes the respective HPC vane arrangement 102. Each rotor shroud 122 is arranged with a respective one of the rotor stages 110. More particularly, each rotor shroud 122 is disposed radially outboard of, axially overlaps and circumscribes the respective rotor stage 110 and its compressor blades 114. Here, each rotor shroud 122 may be configured as a blade outer air seal (BOAS) for the respective rotor stage 110. The rotor shrouds 122 are axially interspersed with the outer platforms 124. Each rotor shroud 122 of FIG. 2, for example, is adjacent and disposed axially between a respective axially neighboring set of the outer platforms 124. Similarly, each outer platform 124B-D of FIG. 2 is adjacent and disposed axially between a respective axially neighboring set of the rotor shrouds 122.

The HPC vane arrangements 102A-E are sequentially arranged longitudinally along the core flowpath 48. The HPC vane arrangement 102A may be configured as an upstream-most vane arrangement in the HPC section 41B longitudinally along the core flowpath 48. The HPC vane arrangement 102A may thereby be a vane arrangement of the HPC section 41B (a) located fluidly closest to the LPC section 41A and its LPC rotor 61 (see FIG. 1) longitudinally along the core flowpath 48 and (b) located farthest from the combustor section 42 (see FIG. 1) longitudinally along the core flowpath 48.

Each of the HPC vane arrangements 102A-E of FIG. 2 includes a plurality of compressor vanes 126A-E (generally referred to as "126"). These compressor vanes 126A-E are arranged and may be equispaced circumferentially around a respective radial inner platform 128A-E (generally referred to as "128") for each respective HPC vane arrangement 102A-E and the propulsion system axis 34 in an array; e.g., an annular compressor vane array.

Each compressor vane 126 has a compressor vane airfoil. Each compressor vane 126 and its vane airfoil are disposed radially between the respective inner platform 128 and the respective outer platform 124. Each compressor vane 126 and its vane airfoil of FIG. 2, for example, project radially across the core flowpath 48 from the respective inner platform 128 to the respective outer platform 124. Each compressor vane 126 and its vane airfoil extend chordwise between a leading edge of the respective compressor vane 126 and its vane airfoil and a trailing edge of the respective compressor vane 126 and its vane airfoil.

Each compressor vane 126A-D of FIG. 2 is moveably coupled to the respective inner platform 128A-D and the respective outer platform 124. Each compressor vane 126A-D of FIG. 2, for example, is configured with an inner vane shaft 130A-D (generally referred to as "130") and an outer vane shaft 132A-D (generally referred to as "132"). The inner vane shaft 130A-D projects radially inward (e.g., in a radial inward direction towards the propulsion system axis 34) from the vane airfoil of the respective compressor blade 114A-D, and this inner vane shaft 130A-D is pivotally coupled to the respective inner platform 128A-D. The outer vane shaft 132A-D projects radially outward (e.g., in a radial outward direction away from the propulsion system axis 34) from the vane airfoil of the respective compressor blade 114A-D, and this outer vane shaft 132A-D is pivotally coupled to the respective outer platform 124. The outer vane shaft 132A-D of FIG. 2 also projects radially across the HPC wall structure 100 (e.g., into the inner housing compartment 82) to a respective distal radial outer end of the respective outer vane shaft 132A-D. Each compressor vane 126A-D is thereby configured to pivot about a pivot axis 134A-D (generally referred to as "134") of that respective compressor vane 126A-D, for example, to change a pitch of the respective compressor vane 126A-D. Moreover, each HPC vane arrangement 102A-D is configured as a variable (e.g., adjustable) vane arrangement.

The compressor vane 126E of FIG. 2 is fixedly connected to the respective inner platform 128E to the respective outer platform 124E. Each compressor vane 126E of FIG. 2, for example, is formed integral with or otherwise fixedly attached to the inner platform 128E. Each compressor vane 126E of FIG. 2 is also formed integral with or otherwise fixedly attached to the outer platform 124E. Each compressor vane 126E is thereby configured with a fixed pitch. Moreover, the HPC vane arrangement 102E is configured as a fixed (e.g., non-adjustable) vane arrangement. All of the HPC vane arrangements within the HPC section 41B and downstream of the HPC vane arrangement 102E may also each be configured as a fixed vane arrangement.

Figure 3:
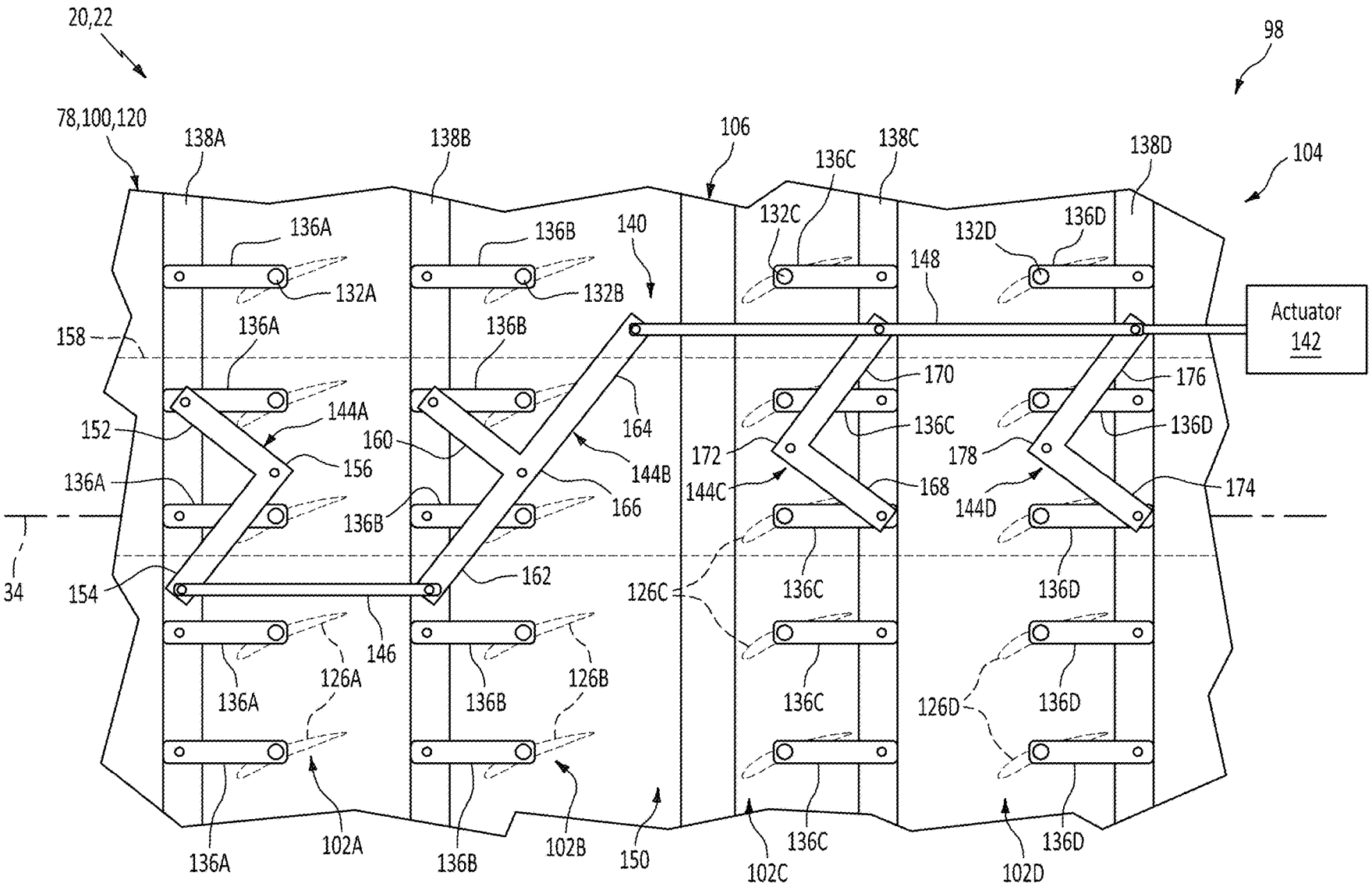
FIGS. 3-6 are partial plan view illustrations of the assembly with various vane actuation system arrangements.

The vane actuation system 104 is configured to (e.g., synchronously) actuate movement of the compressor vanes 126A-D in the HPC vane arrangements 102A-D. Referring to FIG. 3, the vane actuation system 104 includes a set of vane actuation arms 136A-D (generally referred to as "136") for each HPC vane arrangement 102A-D, a synchronization ring 138A-D (generally referred to as "138") for each HPC vane arrangement 102A-D, a linkage system 140 and an actuator 142. The linkage system 140 of FIG. 3 includes a plurality of actuation cranks 144A-D (generally referred to as "144"), a linkage 146 and a linkage 148.

Each vane actuation arm set includes a plurality of the vane actuation arms 136. Referring to FIG. 2, each of these vane actuation arms 136A-D is connected to and pivotable with a respective one of the compressor vanes 126A-D about its vane pivot axis 134A-D. Each vane actuation arm 136A-D of FIG. 2, for example, is disposed at (e.g., on, adjacent or proximate) the outer end of the outer shaft 132A-D for the respective compressor vane 126A-D; e.g., within the inner housing compartment 82. The HPC wall structure 100 of FIG. 2 is thereby located radially between the vane airfoil of the respective compressor vane 126A-D and the respective vane actuation arm 136A-D.

The vane actuation arms 136A and the vane actuation arms 136B of FIG. 2 are configured as upstream and/or forward extending actuation arms. Each of these vane actuation arms 136A and 136B of FIG. 2, for example, projects longitudinally upstream along the core flowpath 48 and/or axially forward along the propulsion system axis 34 out from the respective outer shaft 132A, 132B to a distal end of the respective vane actuation arm 136A, 136B. The distal ends of the vane actuation arms 136A and 136B are thereby located longitudinally upstream and/or axially forward of the respective outer shafts 132A and 132B. By contrast, the vane actuation arms 136C and the vane actuation arms 136D of FIG. 2 are configured as downstream and/or aft extending actuation arms. Each of these vane actuation arms 136C and 136D of FIG. 2, for example, projects longitudinally downstream along the core flowpath 48 and/or axially aft along the propulsion system axis 34 out from the respective outer shaft 132C, 132D to a distal end of the respective vane actuation arm 136C, 136D. The distal ends of the vane actuation arms 136C and 136D are thereby located longitudinally downstream and/or axially aft of the respective outer shafts 132C and 132D. With this arrangement, an axial region 150 between the outer shafts 132B for the vane arrangement 102B and the outer shafts 132C for the vane arrangement 102C is opened up (e.g., space is made available) for one or more other propulsion system systems and/or components, such as the air circuit 106 as described below in further detail.

Each synchronization ring 138 is disposed radially outboard of the HPC wall structure 100; e.g., within the inner housing compartment 82. Each synchronization ring 138 may also be disposed radially inboard of a respective set of the vane actuation arms 136. Each synchronization ring 138 of FIG. 2, for example, is arranged radially between the HPC wall structure 100 and the respective set of the vane actuation arms 136. Each synchronization ring 138 extends circumferentially about (e.g., completely around) the HPC wall structure 100 and the propulsion system axis 34. Each synchronization ring 138A-D is pivotally coupled to each vane actuation arm 136A-D in the respective vane actuation arm set, for example at the distal ends of the respective vane actuation arms 136. Each synchronization ring 138A, 138B of FIG. 2 is thereby located longitudinally upstream and/or axially forward of the respective outer shafts 132A, 132B. By contrast, each synchronization ring 138C, 138D of FIG. 2 is located longitudinally downstream and/or axially aft of the respective outer shafts 132C, 132D. Again, with this arrangement, the axial region 150 between the outer shafts 132B for the vane arrangement 102B and the outer shafts 132C for the vane arrangement 102C is opened up for one or more other propulsion system systems and/or components, such as the air circuit 106 as described below in further detail.

Referring to FIG. 3, the actuation crank 144A includes a ring arm 152 and a linkage arm 154. The ring arm 152 projects along a ring arm trajectory out from an intersection 156 (e.g., a corner such as an elbow joint) between the ring arm 152 and linkage arm 154. This ring arm trajectory includes an axial component in an axial forward and/or upstream direction along the propulsion system axis 34. The ring arm trajectory may (or may not) also include a circumferential component in a first circumferential direction about the propulsion system axis 34. For ease of description, the first circumferential direction and an opposite second circumferential direction about the propulsion system axis 34 are described herein with respect to a common reference view. Where the common reference view is an upstream and/or forward facing reference view (right-to-left in FIG. 3), the first circumferential direction is a clockwise direction about the propulsion system axis 34 and the second circumferential direction is a counterclockwise direction about the propulsion system axis 34. Where the common reference view is a downstream and/or aft facing reference view (left-to-right in FIG. 3), the first circumferential direction is the counterclockwise direction about the propulsion system axis 34 and the second circumferential direction is the clockwise direction about the propulsion system axis 34. Referring still to FIG. 3, the linkage arm 154 projects along a linkage arm trajectory out from the inter-arm intersection 156. This linkage arm trajectory includes a circumferential component in the second circumferential direction about the propulsion system axis 34. The linkage arm trajectory may (or may not) also include an axial component in the axial forward and/or upstream direction along the propulsion system axis 34.

The synchronization ring 138A is pivotally coupled to the actuation crank 144A at a distal end of the ring arm 152. The linkage 146 is pivotally coupled to the actuation crank 144A at a distal end of the linkage arm 154. A fixed structure 158 such as a torque box is pivotally coupled to the actuation crank 144A at the inter-arm intersection 156. The actuation crank 144A is thereby configured to pivot about a crank pivot axis coaxial with the coupling between the actuation crank 144A and the fixed structure 158. This crank pivot axis may be perpendicular to and coincident with the propulsion system axis 34; however, the present disclosure is not limited to such an exemplary arrangement.

The actuation crank 144B includes a ring arm 160, a first linkage arm 162 and a second linkage arm 164. The ring arm 160 projects along a ring arm trajectory out from an intersection 166 (e.g., a T-joint) between the ring arm 160, the first linkage arm 162 and second linkage arm 164. This ring arm trajectory includes an axial component in the axial forward and/or upstream direction along the propulsion system axis 34. The ring arm trajectory may (or may not) also include a circumferential component in the first circumferential direction about the propulsion system axis 34. The first linkage arm 162 projects along a first linkage arm trajectory out from the inter-arm intersection 166. This first linkage arm trajectory includes a circumferential component in the second circumferential direction about the propulsion system axis 34. The first linkage arm trajectory may (or may not) also include an axial component in the axial forward and/or upstream direction along the propulsion system axis 34. The second linkage arm 164 projects along a second linkage arm trajectory out from the inter-arm intersection 166. This second linkage arm trajectory includes a circumferential component in the first circumferential direction about the propulsion system axis 34. The second linkage arm trajectory may (or may not) also include an axial component in an axial aft and/or downstream direction along the propulsion system axis 34.

The synchronization ring 138B is pivotally coupled to the actuation crank 144B at a distal end of the ring arm 160. The linkage 146 is pivotally coupled to the actuation crank 144B at a distal end of the first linkage arm 162. The linkage 148 is pivotally coupled to the actuation crank 144B at a distal end of the second linkage arm 164. The fixed structure 158 is pivotally coupled to the actuation crank 144B at the inter-arm intersection 166. The actuation crank 144B is thereby configured to pivot about a crank pivot axis coaxial with the coupling between the actuation crank 144B and the fixed structure 158. This crank pivot axis may be perpendicular to and coincident with the propulsion system axis 34; however, the present disclosure is not limited to such an exemplary arrangement.

The actuation crank 144C includes a ring arm 168 and a linkage arm 170. The ring arm 168 projects along a ring arm trajectory out from an intersection 172 (e.g., a corner such as an elbow joint) between the ring arm 168 and linkage arm 170. This ring arm trajectory includes an axial component in the axial aft and/or downstream direction along the propulsion system axis 34. The ring arm trajectory may (or may not) also include a circumferential component in the second circumferential direction about the propulsion system axis 34. The linkage arm 170 projects along a linkage arm trajectory out from the inter-arm intersection 172. This linkage arm trajectory includes a circumferential component in the first circumferential direction about the propulsion system axis 34. The linkage arm trajectory may (or may not) also include an axial component in the axial aft and/or downstream direction along the propulsion system axis 34.

The synchronization ring 138C is pivotally coupled to the actuation crank 144C at a distal end of the ring arm 168. The linkage 148 is pivotally coupled to the actuation crank 144C at a distal end of the linkage arm 170. The fixed structure 158 is pivotally coupled to the actuation crank 144C at the inter-arm intersection 172. The actuation crank 144C is thereby configured to pivot about a crank pivot axis coaxial with the coupling between the actuation crank 144C and the fixed structure 158. This crank pivot axis may be perpendicular to and coincident with the propulsion system axis 34; however, the present disclosure is not limited to such an exemplary arrangement.

The actuation crank 144D includes a ring arm 174 and a linkage arm 176. The ring arm 174 projects along a ring arm trajectory out from an intersection 178 (e.g., a corner such as an elbow joint) between the ring arm 174 and linkage arm 176. This ring arm trajectory includes an axial component in the axial aft and/or downstream direction along the propulsion system axis 34. The ring arm trajectory may (or may not) also include a circumferential component in the second circumferential direction about the propulsion system axis 34. The linkage arm 176 projects along a linkage arm trajectory out from the inter-arm intersection 178. This linkage arm trajectory includes a circumferential component in the first circumferential direction about the propulsion system axis 34. The linkage arm trajectory may (or may not) also include an axial component in the axial aft and/or downstream direction along the propulsion system axis 34.

The synchronization ring 138D is pivotally coupled to the actuation crank 144D at a distal end of the ring arm 174. The linkage 148 is pivotally coupled to the actuation crank 144D at a distal end of the linkage arm 176. The fixed structure 158 is pivotally coupled to the actuation crank 144D at the inter-arm intersection 178. The actuation crank 144D is thereby configured to pivot about a crank pivot axis coaxial with the coupling between the actuation crank 144D and the fixed structure 158. This crank pivot axis may be perpendicular to and coincident with the propulsion system axis 34; however, the present disclosure is not limited to such an exemplary arrangement.

The linkage 146 may be a fixed length linkage such as a pushrod or other link arm. The linkage 146 extends between opposing ends of the linkage 146. The actuation crank 144A and its linkage arm 154 are pivotally coupled to the linkage 146 at the first end of the linkage 146. The actuation crank 144B and its first linkage arm 162 are pivotally coupled to the linkage 146 at the second end of the linkage 146.

The linkage 148 may be a fixed length linkage such as a pushrod or other link arm. The linkage 148 extends between opposing ends of the linkage 148. The actuation crank 144B and its second linkage arm 164 are pivotally coupled to the linkage 148 at the first end of the linkage 148. The actuation crank 144C and its linkage arm 170 are pivotally coupled to the linkage 148 at an intermediate location (e.g., a midpoint) between the first end and the second end of the linkage 148. The actuation crank 144D and its linkage arm 176 are pivotally coupled to the linkage 148 at the second end of the linkage 148.

The actuator 142 may be configured as a linear actuator such as a hydraulic, pneumatic or fueldraulic cylinder. The present disclosure, however, is not limited to such an exemplary actuator. The actuator 142, for example, may alternatively be configured as an electric motor. The actuator 142 of FIG. 3 is operatively coupled to the linkage system 140. More particularly, the actuator 142 of FIG. 3 is pivotally coupled to the linkage 148 and/or the actuation crank 144D and its linkage arm 176. With this arrangement, the actuator 142 is operatively coupled to the compressor vanes 126A-D sequentially through the linkage system 140, the synchronization rings 138A-D and the vane actuation arms 136.

During operation, the vane actuation system 104 of FIG. 3 may selectively synchronously pivot the compressor vanes 126A-D in a common first direction about their vane pivot axes 134A-D (see FIG. 2) or a common second direction about their vane pivot axes 134A-D (see FIG. 2). For example, when the actuator 142 pushes the linkage 148 and/or the linkage arm 176 in the axial forward and/or upstream direction, each of the actuation cranks 144 pivots counterclockwise (in the view of FIG. 3) about its respective crank pivot axis. This counterclockwise pivoting of the actuation cranks 144 cause the synchronization rings 138A and 138B to rotate in the second circumferential direction about the propulsion system axis 34. This second circumferential direction rotation of the synchronization rings 138A and 138B cause the compressor vanes 126A and 126B to pivot counterclockwise (in the view of FIG. 3) about their respective vane pivot axis 134A and 134B (see FIG. 2). Simultaneously, the counterclockwise pivoting of the actuation cranks 144 cause the synchronization rings 138C and 138D to rotate in the first circumferential direction about the propulsion system axis 34. This first circumferential direction rotation of the synchronization rings 138C and 138D cause the compressor vanes 126C and 126D to pivot counterclockwise (in the view of FIG. 3) about their respective vane pivot axis 134C and 134D (see FIG. 2). In another example, when the actuator 142 pulls the linkage 148 and/or the linkage arm 176 in the axial aft and/or downstream direction, each of the actuation cranks 144 pivots clockwise (in the view of FIG. 3) about its respective crank pivot axis. This clockwise pivoting of the actuation cranks 144 cause the synchronization rings 138A and 138B to rotate in the first circumferential direction about the propulsion system axis 34. This first circumferential direction rotation of the synchronization rings 138A and 138B cause the compressor vanes 126A and 126B to pivot clockwise (in the view of FIG. 3) about their respective vane pivot axis 134A and 134B (see FIG. 2). Simultaneously, the clockwise pivoting of the actuation cranks 144 cause the synchronization rings 138C and 138D to rotate in the second circumferential direction about the propulsion system axis 34. This second circumferential direction rotation of the synchronization rings 138C and 138D cause the compressor vanes 126C and 126D to pivot clockwise (in the view of FIG. 3) about their respective vane pivot axis 134C and 134D (see FIG. 2).

Figure 4:
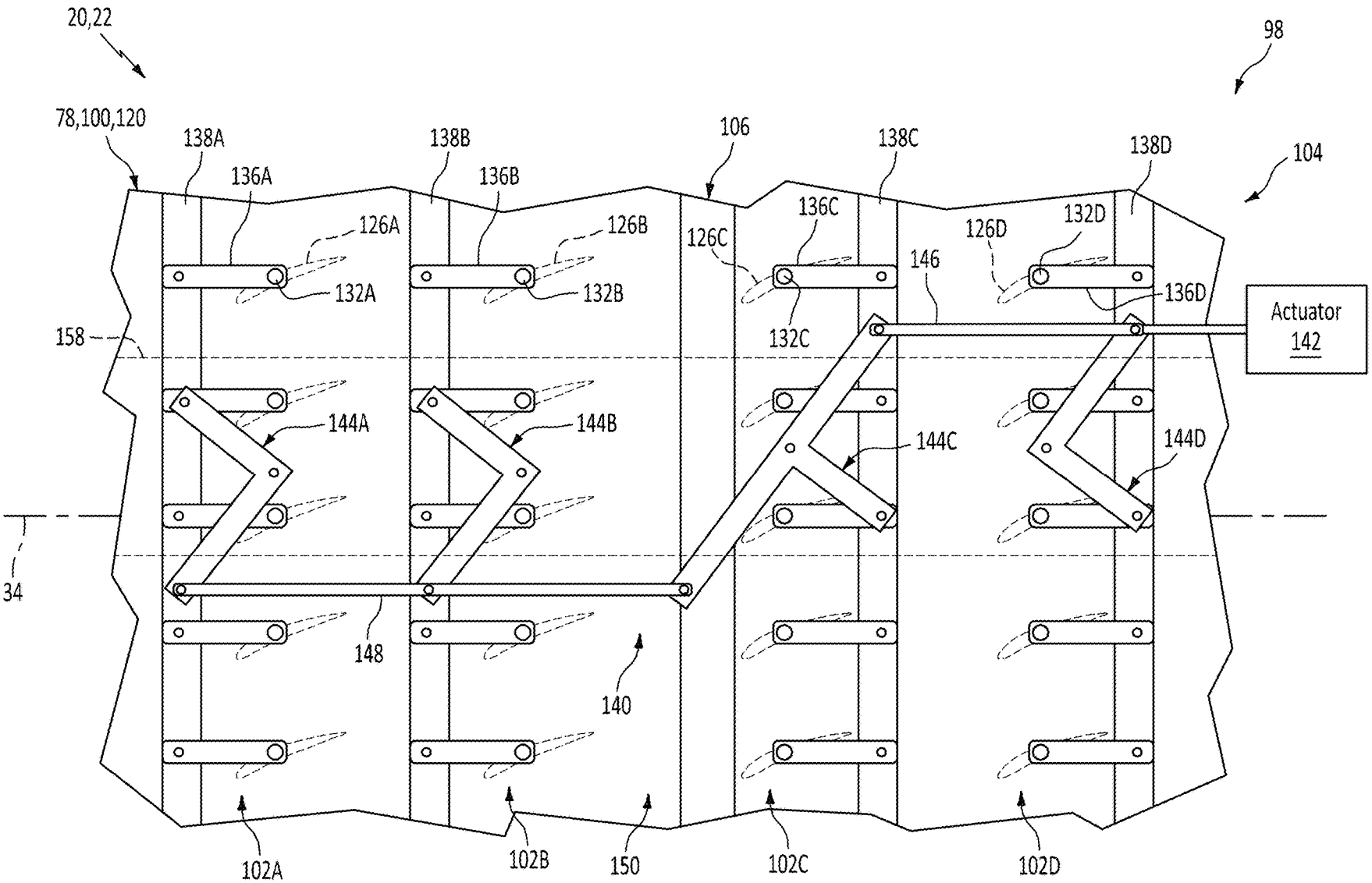
Figure 5:
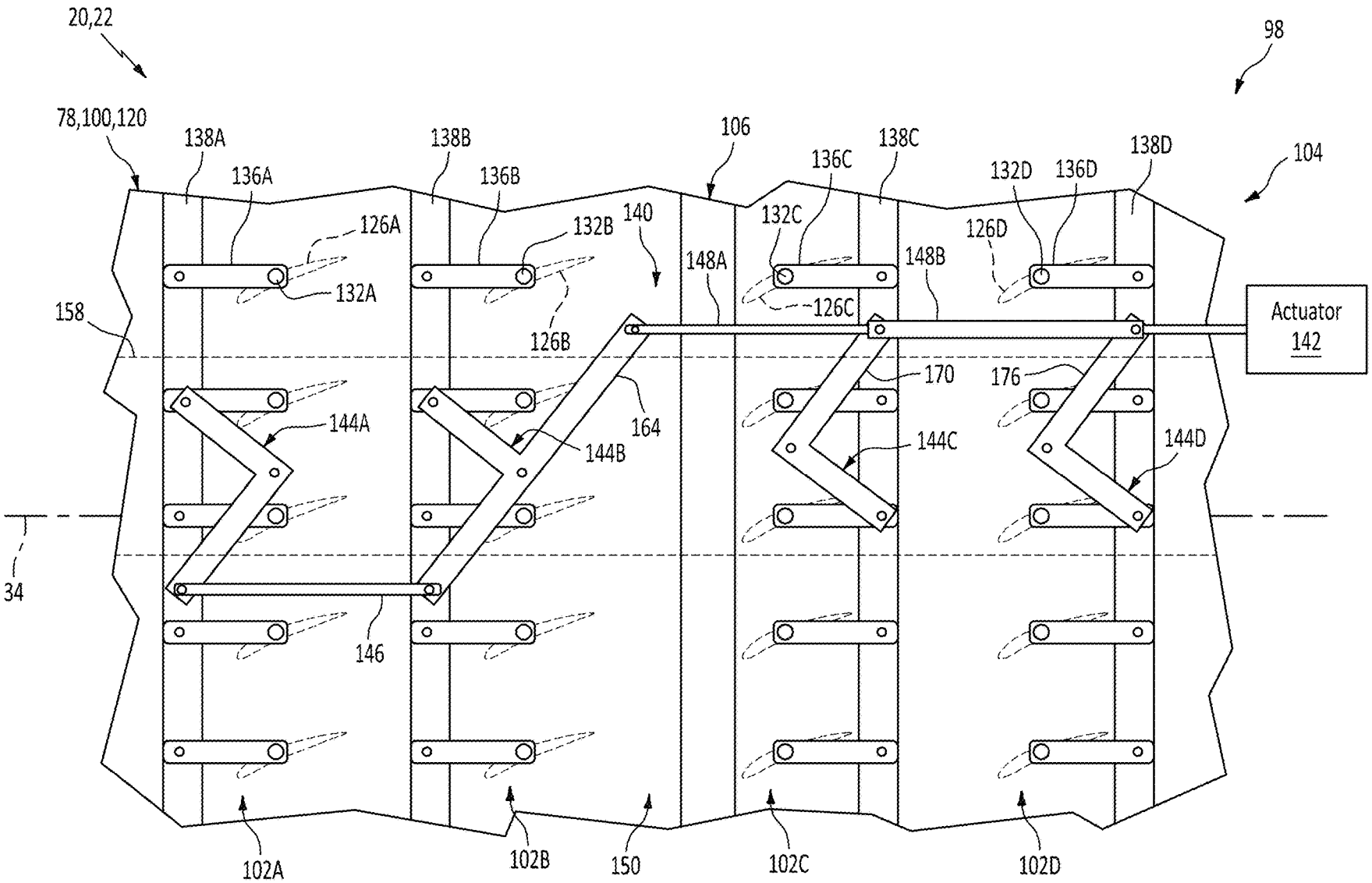

The linkage system 140 is described above with an arrangement of cranks and links. The present disclosure, however, is not limited to such an exemplary linkage system. For example, the arrangement of cranks and linkages may be reversed as shown in FIG. 4. In another example, the unitary linkage 148 shown in FIG. 3 (or FIG. 4) may be replaced by two discrete linkages 148A and 148B as shown in FIG. 5. The linkage 148A of FIG. 5 is pivotally coupled to and operatively couples (a) the actuation crank 144B and its second linkage arm 164 and (b) the actuation crank 144C and its linkage arm 170. The linkage 148B of FIG. 5 is pivotally coupled to and operatively couples (a) the actuation crank 144C and its second linkage arm 170 and (b) the actuation crank 144D and its linkage arm 176. Moreover, while the linkage system 140 is described above as including multiple cranks and linkages, it is contemplated the linkage system 140 may also or alternatively include other kinematic devices and arrangements. For example, referring to FIG. 6, the linkage system 140 includes an actuation shaft 180 and a plurality of linkages 182A-D (generally referred to as "182").

Figure 6:
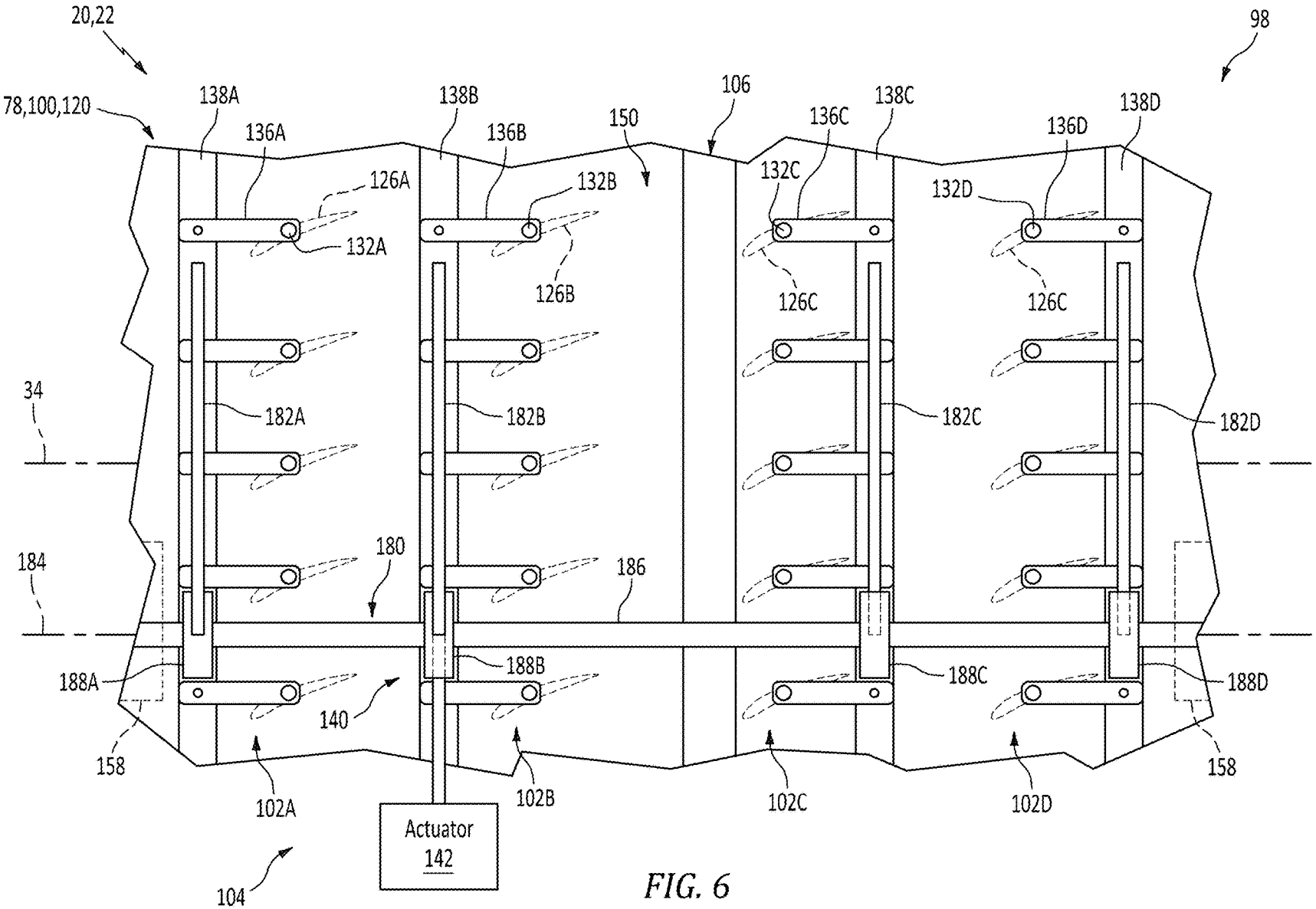

The actuation shaft 180 of FIG. 6 is configured to rotate about a rotational axis 184 of the actuation shaft 180. This shaft axis 184 is radially offset outward from the propulsion system axis 34 and may be parallel to the propulsion system axis 34. The actuation shaft 180 includes a shaft 186 and a plurality of cam elements 188A-D (generally referred to as "188"). The shaft 186 is rotatably coupled to and supported by the fixed structure 158. The cam elements 188 are arranged axially along the shaft 186, where each of the cam elements 188A-D may be axially aligned with a respective one of the synchronization rings 138. Each of the cam elements 188 is connected to and rotatable with the shaft 186. Each of the cam elements 188 projects radially out from the shaft 186 to a radial outer periphery of the respective cam element 188.

Figure 7:
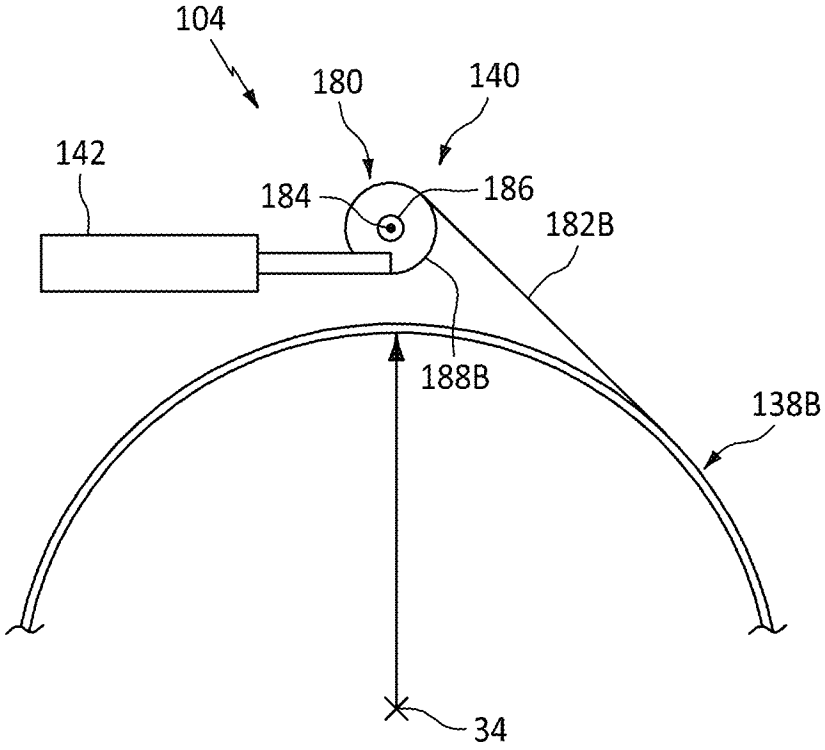

The linkage 182A may be a fixed length linkage such as a pushrod or other link arm. The linkage 182A extends between opposing ends of the linkage 182A. The cam element 188A is pivotally coupled to the linkage 182A at the first end of the linkage 182A. A location of the pivot coupling of FIG. 6 (as similarly shown in FIG. 7) is disposed at a radial outboard of the shaft 186 relative to the propulsion system axis 34. The shaft 186 of FIG. 6 is thereby arranged radially between the pivot coupling location and the propulsion system axis 34. The synchronization ring 138A is pivotally coupled to the linkage 182A at the second end of the linkage 182A.

The linkage 182B may be a fixed length linkage such as a pushrod or other link arm. The linkage 182B extends between opposing ends of the linkage 182B. The cam element 188B is pivotally coupled to the linkage 182B at the first end of the linkage 182B. A location of the pivot coupling of FIG. 6 (see also FIG. 7) is disposed at a radial outboard of the shaft 186 relative to the propulsion system axis 34. The shaft 186 of FIG. 6 is thereby arranged radially between the pivot coupling location and the propulsion system axis 34. The synchronization ring 138B is pivotally coupled to the linkage 182B at the second end of the linkage 182B.

Figure 8:
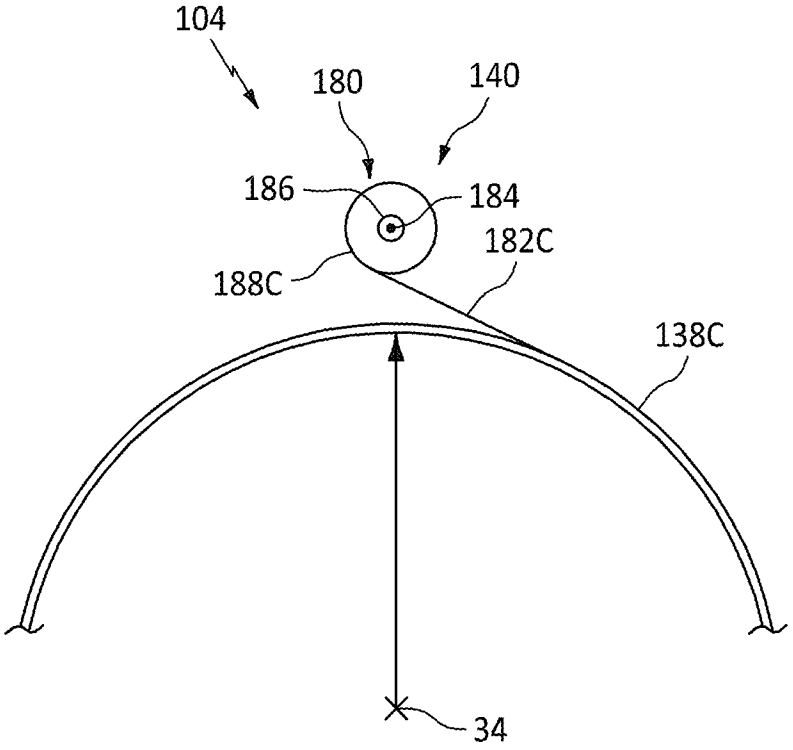
FIGS. 7 and 8 are partial cross-sectional illustrations at various axial locations along the actuation system of FIG. 6.

The linkage 182C may be a fixed length linkage such as a pushrod or other link arm. The linkage 182C extends between opposing ends of the linkage 182C. The cam element 188C is pivotally coupled to the linkage 182C at the first end of the linkage 182C. A location of the pivot coupling of FIG. 6 (see also FIG. 8) is disposed at a radial inboard of the shaft 186 relative to the propulsion system axis 34. The pivot coupling location of FIG. 6 is thereby arranged radially between the shaft 186 and the propulsion system axis 34. The synchronization ring 138C is pivotally coupled to the linkage 182C at the second end of the linkage 182C.

The linkage 182D may be a fixed length linkage such as a pushrod or other link arm. The linkage 182D extends between opposing ends of the linkage 182D. The cam element 188D is pivotally coupled to the linkage 182D at the first end of the linkage 182D. A location of the pivot coupling of FIG. 6 (as similarly shown in FIG. 8) is disposed at a radial inboard of the shaft 186 relative to the propulsion system axis 34. The pivot coupling location of FIG. 6 is thereby arranged radially between the shaft 186 and the propulsion system axis 34. The synchronization ring 138D is pivotally coupled to the linkage 182D at the second end of the linkage 182D.

The actuator 142 of FIG. 6 is pivotally coupled to the cam element 188B. A location of the pivot coupling of FIG. 6 (see also FIG. 7) is disposed at a radial inboard of the shaft 186 relative to the propulsion system axis 34. The pivot coupling location of FIG. 6 is thereby arranged radially between the shaft 186 and the propulsion system axis 34. However, it is contemplated the actuator 142 may alternatively be operatively coupled to the cam element 188B at another location. Moreover, it is contemplated the actuator 142 may alternatively be operatively coupled to another one of the cam elements 188A, 188C, 188D or an additional cam element dedicated to coupling the actuator 142 to the shaft 186.

During operation of the vane actuation system 104 of FIG. 6, the actuator 142 may rotate the actuation shaft 180 in the first circumferential direction (e.g., counterclockwise) or the second circumferential direction (e.g., clockwise) about the shaft axis 184. When the actuation shaft 180 rotates in the first circumferential direction, the linkages 182A and 182B respectively rotate the synchronization rings 138A and 138B in the first circumferential direction about the propulsion system axis 34. This first circumferential direction rotation of the synchronization rings 138A and 138B cause the compressor vanes 126A and 126B to pivot clockwise (in the view of FIG. 6) about their respective vane pivot axes 134A and 134B (see FIG. 2). Simultaneously, the linkages 182C and 182D respectively rotate the synchronization rings 138C and 138D in the second circumferential direction about the propulsion system axis 34. This second circumferential direction rotation of the synchronization rings 138C and 138D cause the compressor vanes 126C and 126D to pivot clockwise (in the view of FIG. 6) about their respective vane pivot axes 134C and 134D (see FIG. 2). By contrast, when the actuation shaft 180 rotates in the second circumferential direction, the linkages 182A and 182B respectively rotate the synchronization rings 138A and 138B in the second circumferential direction about the propulsion system axis 34. This second circumferential direction rotation of the synchronization rings 138A and 138B cause the compressor vanes 126A and 126B to pivot counterclockwise (in the view of FIG. 6) about their respective vane pivot axes 134A and 134B (see FIG. 2). Simultaneously, the linkages 182C and 182D respectively rotate the synchronization rings 138C and 138D in the first circumferential direction about the propulsion system axis 34. This first circumferential direction rotation of the synchronization rings 138C and 138D cause the compressor vanes 126C and 126D to pivot counterclockwise (in the view of FIG. 6) about their respective vane pivot axes 134C and 134D (see FIG. 2).

Referring to FIG. 2, an airflow inlet 190 into the air circuit 106 is disposed along the core flowpath 48 within the HPC section 41B. The circuit inlet 190 of FIG. 2, for example, is disposed axially and longitudinally between (a) the rotor stage 110B and its array of the compressor blades 114B and (b) the HPC vane arrangement 102C and its array of the compressor vanes 126C. The circuit inlet 190 of FIG. 2 is thereby located aft and/or downstream of the compressor blades 114B and forward and/or upstream of the compressor vanes 126C.

Figure 9C:
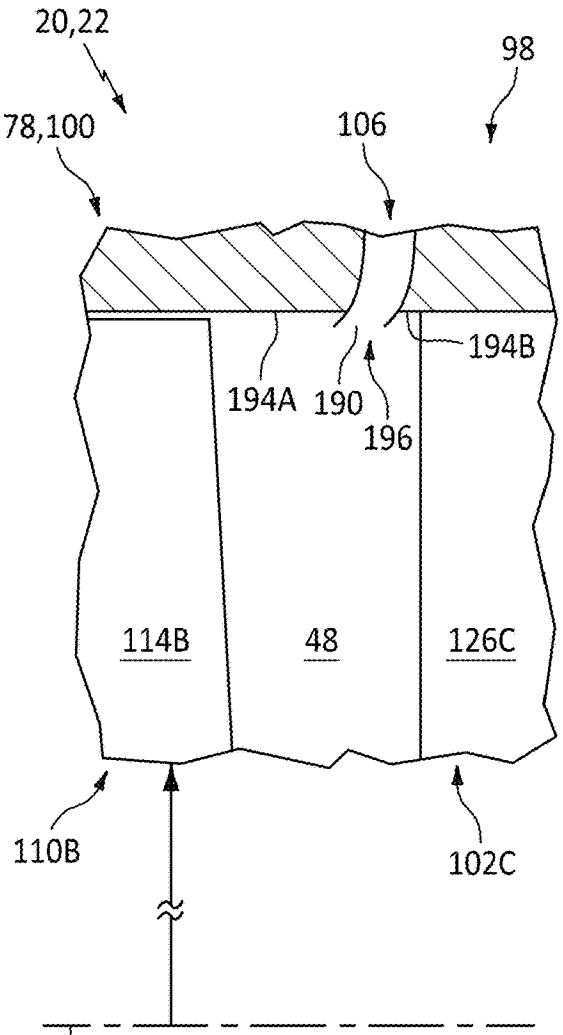
FIGS. 9A-C are partial sectional illustrations of the assembly with various air circuit inlet arrangements.
Figure 9B:
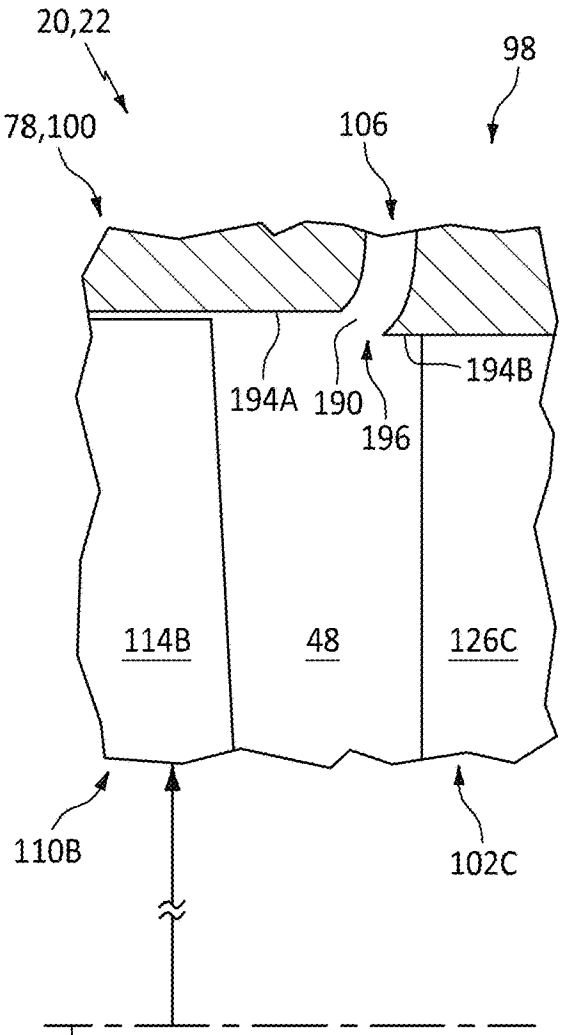
Figure 9A:
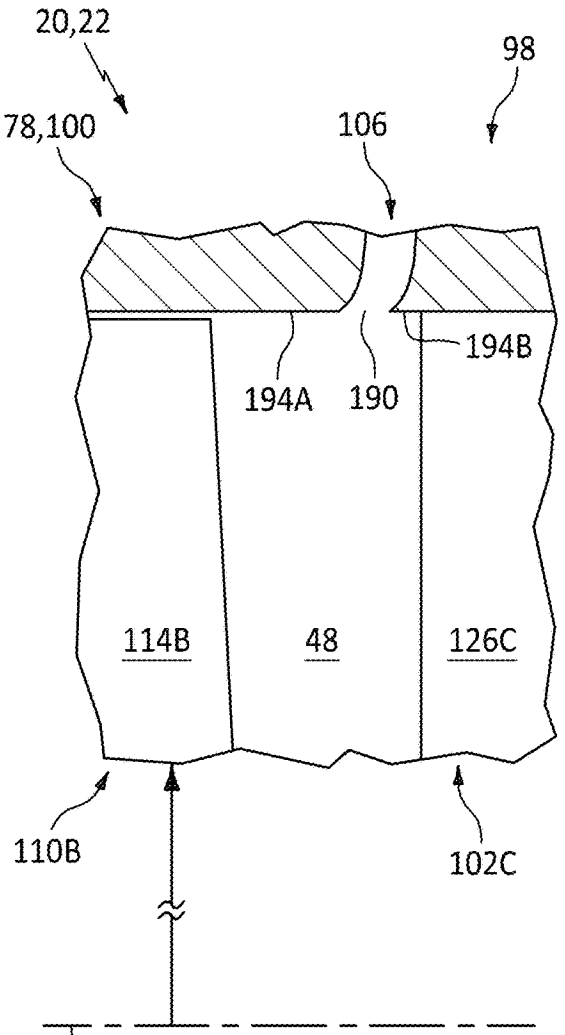

The circuit inlet 190 is configured as or otherwise includes a bleed aperture. The circuit inlet 190 of FIG. 2, for example, is configured to bleed core air from the core flowpath 48 and direct that bled core air into a plenum 192 of the air circuit 106 for subsequent provision to the air system 108. Referring to FIG. 9A, the circuit inlet 190 may be flush with the outer peripheral boundary of the core flowpath 48 along the HPC wall structure 100. The circuit inlet 190 of FIG. 9A, for example, is a port in the HPC wall structure 100, where the circuit inlet 190 is inline with a trajectory (e.g., a substantially straight-line or otherwise continuous trajectory) of the outer peripheral boundary of the core flowpath 48 along the HPC wall structure 100. A section 194A of the outer peripheral boundary of the core flowpath 48 adjacent and upstream of the circuit inlet 190 of FIG. 9A is thereby inline with a section 194B of the outer peripheral boundary of the core flowpath 48 adjacent and downstream of the circuit inlet 190. By contrast, referring to FIG. 9B, the circuit inlet 190 may be offset radially inward into the core flowpath 48 from the section 194A of the outer peripheral boundary of the core flowpath 48 adjacent and upstream of the circuit inlet 190. Here, the section 194B of the outer peripheral boundary of the core flowpath 48 adjacent and downstream of the circuit inlet 190 is also radially offset from the section 194A of the outer peripheral boundary of the core flowpath 48 adjacent and upstream of the circuit inlet 190. The HPC wall structure 100 may thereby form an air scoop 196 which defines the circuit inlet 190. While the air scoop 196 of FIG. 9B is integrated into the HPC wall structure 100 at a radial step in the outer peripheral boundary of the core flowpath 48, the present disclosure is not limited to such an exemplary air scoop. For example, referring to FIG. 9C, the air scoop 196 may alternatively project radially into the core flowpath 48 out from both sections 194A and 194B of the outer peripheral boundary of the core flowpath 48 upstream and downstream of the circuit inlet 190.

The circuit inlet 190 of FIG. 2 is axially and longitudinally spaced from the rotor stage 110B and its array of the compressor blades 114B by a first offset distance 198. The circuit inlet 190 of FIG. 2 is axially and longitudinally spaced from the HPC vane arrangement 102C and its array of the compressor vanes 126C by a second offset distance 200. This second offset distance 200 may be less than the first offset distance 198 such that the circuit inlet 190 is axially and longitudinally closer to the HPC vane arrangement 102C and its array of the compressor vanes 126C than the rotor stage 110B and its array of the compressor blades 114B. The present disclosure, however, is not limited to such an exemplary arrangement. For example, it is contemplated the first offset distance 198 may alternatively be equal to or less than the second offset distance 200 with other HPC section configurations.

Figure 10B:
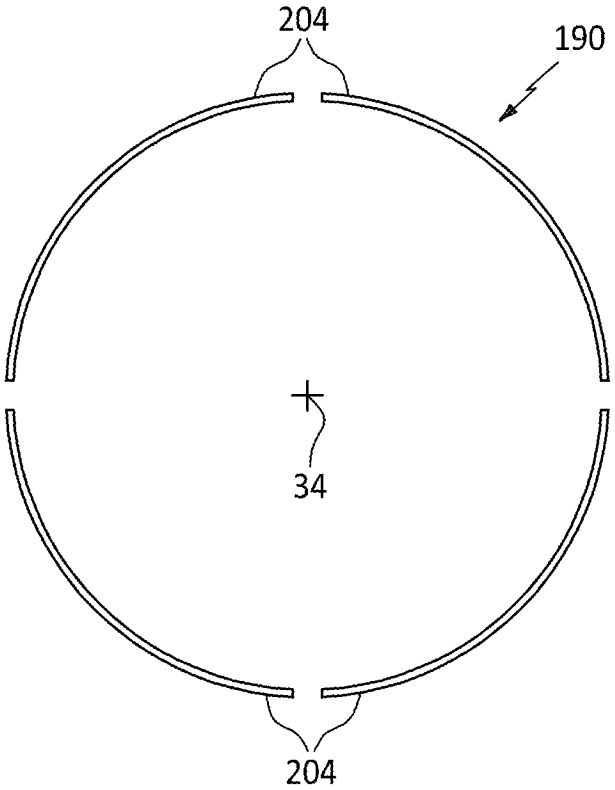
FIGS. 10A and 10B are schematic illustrations of various air circuit inlet arrangements.
Figure 10A:
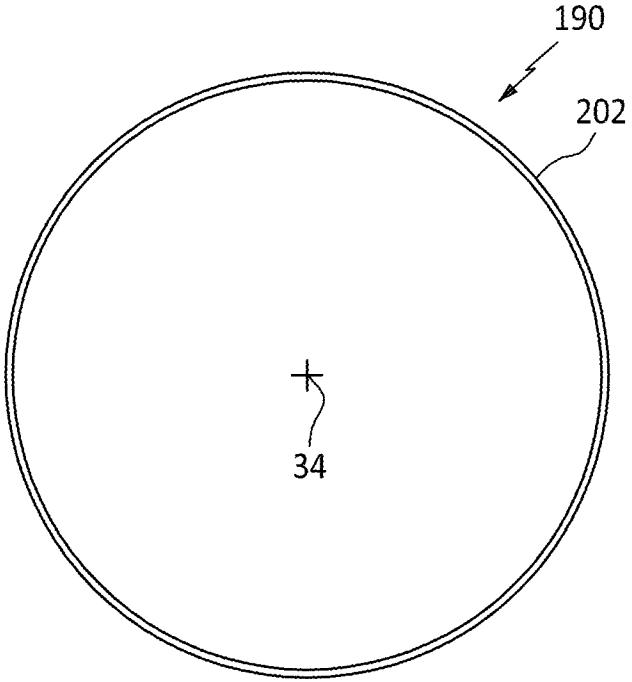

Referring to FIG. 10A, the circuit inlet 190 may be configured as a single bleed aperture 202; e.g., an annular aperture such as an annular slot. Alternatively, referring to FIG. 10B, the circuit inlet 190 may be collectively formed by a plurality of bleed apertures 204 arranged circumferentially about the propulsion system axis 34 in an array; e.g., an annular array.

Figure 11:
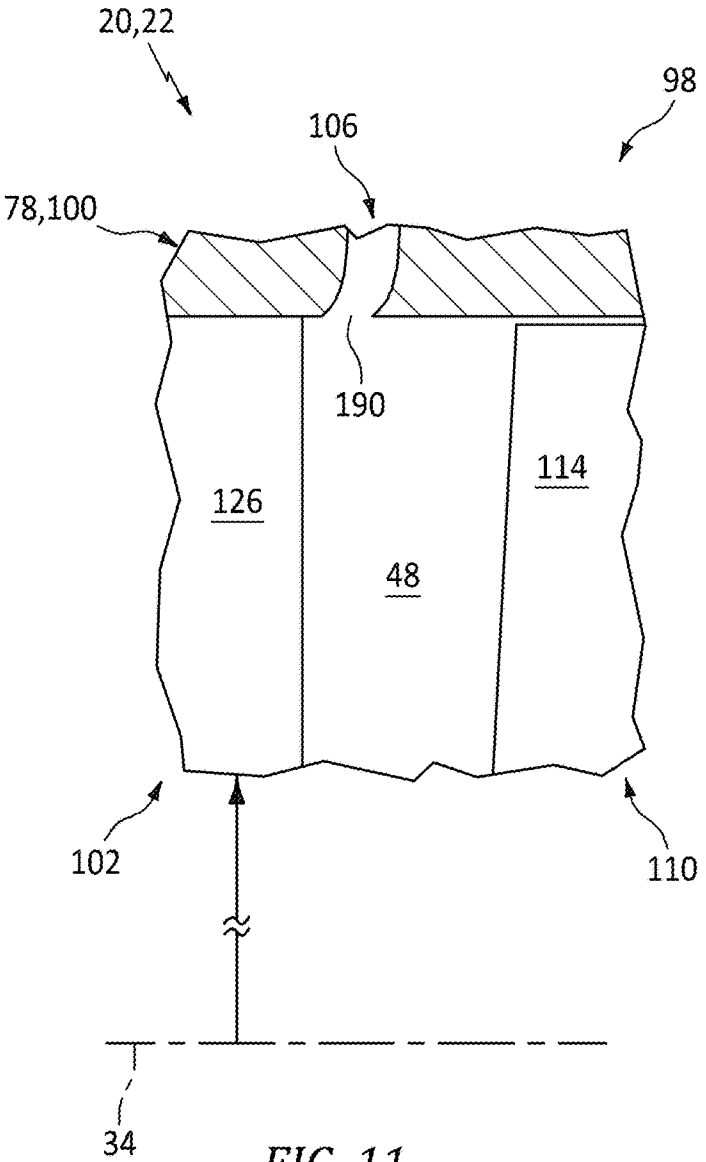
FIG. 11 is a partial sectional illustration of the assembly with another air circuit inlet arrangement.

While the circuit inlet 190 is described above as being disposed axially and longitudinally between (a) the rotor stage 110B and its array of the compressor blades 114B and (b) the HPC vane arrangement 102C and its array of the compressor vanes 126C, the present disclosure is not limited to such an exemplary arrangement. For example, the circuit inlet 190 may alternatively be located aft and/or downstream of the compressor blades 114A and forward and/or upstream of the compressor vanes 126B. In another example, the circuit inlet 190 may alternatively be located aft and/or downstream of the compressor blades 114C and forward and/or upstream of the compressor vanes 126D. Moreover, while the circuit inlet 190 is described above as being next to and downstream of a respective rotor stage 110 and next to and upstream of a respective HPC vane arrangement 102, it is contemplated the circuit inlet 190 may alternatively be located next to and downstream of a respective HPC vane arrangement 102 and next to and upstream of a respective rotor stage 110 as shown in FIG. 11.

While the propulsion system assembly 98 is described above with respect to the HPC section 41B of the turbine engine 24, the present disclosure is not limited to such an exemplary configuration. For example, it is contemplated the propulsion system assembly 98 may alternatively be arranged elsewhere within the compressor section 41. It is further contemplated the vane actuation system 104 may alternatively be used for vanes within, for example, the turbine section 43.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for an aircraft powerplant, comprising:

a plurality of first vanes arranged circumferentially about an axis in a first vane array, each of the plurality of first vanes pivotable about a respective first vane pivot axis;

a plurality of second vanes arranged circumferentially about the axis in a second vane array, each of the plurality of second vanes pivotable about a respective second vane pivot axis;

a rotor rotatable about the axis and including a plurality of first blades, the plurality of first blades arranged circumferentially about the axis in a first blade array, and the first blade array arranged axially next to and between the first vane array and the second vane array along a flowpath; and an actuation system including a first ring and a second ring, the first ring operatively coupled to each of the plurality of first vanes, and the second ring operatively coupled to each of the plurality of second vanes;

during a first mode, the actuation system configured to rotate the first ring in a first rotational direction about the axis, rotate the second ring in a second rotational direction about the axis, and pivot each of the plurality of first vanes about the respective first vane pivot axis and each of the plurality of second vanes about the respective second vane pivot axis in a common first pivot direction; and during a second mode, the actuation system configured to rotate the first ring in the second rotational direction about the axis, rotate the second ring in the first rotational direction about the axis, and pivot each of the plurality of first vanes about the respective first vane pivot axis and each of the plurality of second vanes about the respective second vane pivot axis in a common second pivot direction.

2. The assembly of claim 1, wherein the actuation system further includes an actuator, the first ring operatively couples the actuator to each of the plurality of first vanes, the second ring operatively couples the actuator to each of the plurality of second vanes, and the actuation system is configured to rotate the first ring and the second ring using the actuator.

3. The assembly of claim 1, wherein the actuation system further includes an actuator; and a linkage system operatively coupling the actuator to the first ring and the second ring.

4. The assembly of claim 1, further comprising:

a fixed structure;

the actuation system further including a first crank, a second crank and a first linkage, the first crank pivotally coupled to the fixed structure and the first ring, the second crank pivotally coupled to the fixed structure and the second ring, and the first linkage operatively coupling and pivotally coupled to the first crank and the second crank.

5. The assembly of claim 4, wherein at least one of the first crank includes a first ring arm and a first linkage arm, the first ring is pivotally coupled to the first ring arm, the first linkage is pivotally coupled to the first linkage arm, and the fixed structure is pivotally coupled to the first crank at an intersection between the first ring arm and the first linkage arm; or the second crank includes a second ring arm and a second linkage arm, the second ring is pivotally coupled to the second ring arm, the first linkage is pivotally coupled to the second linkage arm, and the fixed structure is pivotally coupled to the second crank at an intersection between the second ring arm and the second linkage arm.

6. The assembly of claim 5, wherein the first ring arm projects away from the first linkage arm in a first axial direction along the axis; and the second ring arm projects away from the second linkage arm in a second axial direction along the axis.

7. The assembly of claim 5, wherein the first linkage arm projects away from the first ring arm in a first circumferential direction about the axis; and the second linkage arm projects away from the second ring arm in the first circumferential direction about the axis.

8. The assembly of claim 4, further comprising:

a plurality of third vanes arranged circumferentially about the axis in a third vane array, each of the plurality of third vanes pivotable about a respective third vane pivot axis;

the rotor further including a plurality of second blades, the plurality of second blades arranged circumferentially about the axis in a second blade array, and the second blade array arranged axially next to and between the second vane array and the third vane array along the flowpath;

the actuation system further including a third ring, a third crank and a second linkage, the third ring operatively coupled to each of the plurality of third vanes, the third crank pivotally coupled to the fixed structure and the third ring, and the second linkage operatively coupling and pivotally coupled to the second crank and the third crank.

9. The assembly of claim 8, wherein the first crank includes a first ring arm and a first linkage arm, the first ring is pivotally coupled to the first ring arm, the first linkage is pivotally coupled to the first linkage arm, and the fixed structure is pivotally coupled to the first crank at an intersection between the first ring arm and the first linkage arm;

the second crank includes a second ring arm and a plurality of second linkage arms, the second ring is pivotally coupled to the second ring arm, the first linkage is pivotally coupled to a first of the plurality of second linkage arms, the second linkage is pivotally coupled to a second of the plurality of second linkage arms, and the fixed structure is pivotally coupled to the second crank at an intersection between the second ring arm and the plurality of second linkage arms; and the third crank includes a third ring arm and a third linkage arm, the third ring is pivotally coupled to the third ring arm, the second linkage is pivotally coupled to the third linkage arm, and the fixed structure is pivotally coupled to the third crank at an intersection between the third ring arm and the third linkage arm.

10. The assembly of claim 1, further comprising:

an actuation shaft including a shaft, a first cam element and a second cam element axially spaced from the first cam element along the shaft, the first cam element rotatable with the shaft, and the second cam element rotatable with the shaft;

a first linkage operatively coupling and pivotally coupled to first cam element and the first ring; and a second linkage operatively coupling and pivotally coupled to second cam element and the second ring.

11. The assembly of claim 10, wherein a coupling between the first linkage and the first cam element is disposed radially between the first ring and the shaft; and the shaft is disposed radially between the second ring and a coupling between the second linkage and the second cam element.

12. The assembly of claim 10, wherein the first linkage and the second linkage are disposed to a common circumferential side of the actuation shaft about the axis.

13. The assembly of claim 1, wherein the actuation system further includes a plurality of first actuation arms, each of the plurality of first actuation arms movable with a respective one of the plurality of first vanes, and each of the plurality of first actuation arms pivotably coupled to the first ring; and a plurality of second actuation arms, each of the plurality of second actuation arms movable with a respective one of the plurality of second vanes, and each of the plurality of second actuation arms pivotably coupled to the second ring.

14. The assembly of claim 13, wherein at least one of each of the plurality of first actuation arms is disposed radially outboard of and axially overlaps the first ring; or each of the plurality of second actuation arms is disposed radially outboard of and axially overlaps the second ring.

15. The assembly of claim 1, wherein the first vane pivot axis of each of the plurality of first vanes and the second vane pivot axis of each of the plurality of second vanes are arranged axially between the first ring and the second ring along the axis.

16. The assembly of claim 1, further comprising an air circuit comprising a bleed aperture, the bleed aperture disposed at an outer peripheral boundary of the flowpath axially between the first vane array and the first blade array, and the air circuit configured to bleed air from the flowpath through the bleed aperture.

17. The assembly of claim 1, further comprising a wall structure extending axially along and circumferentially about the first vane array, the second vane array and the first blade array, the wall structure forming an outer peripheral boundary of the flowpath, and the wall structure disposed radially between (a) the flowpath and (b) the first ring and the second ring.

18. The assembly of claim 1, further comprising:

a compressor section comprising the plurality of first vanes, the plurality of second vanes and the rotor;

a combustor section; and a turbine section;

the flowpath extending through the compressor section, the combustor section and the turbine section from an airflow inlet into the flowpath to a combustion products exhaust from the flowpath.

19. An assembly for an aircraft powerplant, comprising:

a plurality of first vanes arranged circumferentially about an axis in a first vane array, each of the plurality of first vanes pivotable about a respective first vane pivot axis;

a plurality of second vanes arranged circumferentially about the axis in a second vane array, each of the plurality of second vanes pivotable about a respective second vane pivot axis;

a rotor rotatable about the axis and including a plurality of first blades, the plurality of first blades arranged circumferentially about the axis in a first blade array;

a wall structure extending axially along and circumferentially about the first vane array, the second vane array and the first blade array, the wall structure forming an outer peripheral boundary of a flowpath that extends axially across the first vane array, the second vane array and the first blade array with the first blade array arranged axially next to and between the first vane array and the second vane array along the flowpath; and an actuation system including a first ring, a second ring, a linkage system and an actuator, the first ring operatively coupled to each of the plurality of first vanes, and the second ring operatively coupled to each of the plurality of second vanes, the linkage system operatively coupling the actuator to the first ring and the second ring, and the actuation system configured to pivot the plurality of first vanes and the plurality of second vanes by using the actuator to rotate the first ring and the second ring in opposite directions about the axis.

* * * * *